United States Patent [19]

Osseyran

[11] Patent Number: 4,785,272

[45] Date of Patent: Nov. 15, 1988

[54] ELECTOMAGNETIC DEFLECTION UNIT

[75] Inventor: Anwar Osseyran, Eindhoven, Netherlands

[73] Assignee: U.S. Philips Corp., New York, N.Y.

[21] Appl. No.: 92,254

[22] Filed: Sep. 1, 1987

[30] Foreign Application Priority Data

Sep. 24, 1986 [NL] Netherlands ..... 8602407

[51] Int. Cl.[4] ..... H01H 5/00

[52] U.S. Cl. ..... 335/213; 335/210

[58] Field of Search ..... 335/210, 213; 313/421, 313/426, 427, 428, 431

[56] References Cited

U.S. PATENT DOCUMENTS 4,272,727 6/1981 Nieuwendijk et al. ..... 335/213

4,524,340 6/1985 Sluyterman ..... 335/210 X

*Primary Examiner*—George Harris

*Attorney, Agent, or Firm*—Thomas A. Briody; Jack E. Haken; Leroy Eason

[57] ABSTRACT

A cathode ray tube electromagnetic deflection unit comprising field deflection coils (8,8') and line deflection coils (10, 10'), both of the saddle type, wound directly onto an annular support (4). The field deflection coils consist of a first part (11) wound against the inner side of the support (4) and a second part (12) wound against the line deflection coils (10, 10'). At the narrow end (5) of the support (4) the second part (12) extends in the longitudinal direction further than the line deflection coils (10,10'), and the first and second parts (11, 12) are electrically connected in series. Such a deflection unit has high sensitivity and minimizes coma errors.

2 Claims, 2 Drawing Sheets

ELECTOMAGNETIC DEFLECTION UNIT

BACKGROUND OF THE INVENTION

1. Field of the Invention

The invention relates to an electromagnetic deflection unit for a cathode-ray tube comprising:

a hollow annular support having a longitudinal axis and a narrow and a wide end, a set of field deflection coils of the saddle type for field deflection of the CRT electron beam, these deflection coils being located on respective sides of a field coil separation plane through the longitudinal axis of the support and having a plurality of turns which mainly extend longitudinally of the support, and a set of line deflection coils of the saddle type for line deflection of the electron beam, the deflection coils of both sets being directly wound onto the support on the inner side thereof.

2. Description of the Related Art

Such a deflection unit is known from European Pat. No. EP 0 102 658 A1, which corresponds to U.S. Pat. No. 4,484,166, issued Nov. 20, 1984.

Cathode-ray tubes have a neck-shaped portion, in one end of which an electron gun is arranged and the other end of which passes into a conical portion which is joined by a screen. An electromagnetic deflection unit is arranged to surround this neck-shaped portion and to engage the conical portion. The narrow end of the support is located near the electron gun, while the wide end engages the conical portion of the cathode-ray tube.

Deflection units having coils directly wound onto the support afford great advantages, for example, that their manufacture requires a smaller number of assembling steps, that they can be wound with comparatively simple machines and that they are accurately reproducible. Such deflection units hitherto also have a disadvantage, however.

The deflection coils for line deflection produce a high-frequency magnetic field in the cathode-ray tube during operation. The sensitivity of these coils is strongly influenced by their distance from the cathode-ray tube. If they are located very close to this tube, a considerably smaller amount of energy need be dissipated in these coils for obtaining a certain magnetic field strength than if they are located close to the support and thus farther remote from this tube. This results in that, from a view point of energy consumption of the line deflection coils, it is favourable to first arrange the field deflection coils (which produce a low-frequency magnetic field and whose sensitivity is less dependent upon the distance from the cathode-ray tube) to engage the inner side of the support and then to provide the line deflection coils on the inner side of the field deflection coils.

In order to miniize Y coma errors, i.e. coma errors in directions at right angles to the direction of line deflection, it is of importance that the field deflection coils extend to an area closer to the electron gun than the line deflection coils. At the narrow end of the support, the field deflection coils consequently must extend in the direction of the longitudinal axis of the support beyond the line deflection coils. This results in that the line deflection coils must first be wound, directly against the inner side of the support, whereupon the field deflection coils mut be wound on the inner side thereof. In fact, if first the long field deflection coils should be wound onto the support, during the step of winding the shorter line deflection coils the winding wire would have to be continuously inserted between the turns of those longer coils. Such a method of winding practically cannot be carried out in mass production.

Consequently, two contrasting requirements are imposed on deflection units of the kind described.

For the sake of a high sensitivity of the deflection unit, more particularly of the line deflection coils, first the field deflection coils have to be wound against the inner side of the support and then the line deflection coils have to be wound;

for the sake of minimizing Y coma errors, the line deflection coils have to be wound against the inner side of the support and then the field deflection coils have to be wound.

SUMMARY OF THE INVENTION

The invention has for its object to offer a solution for these contrasting requirements and to provide a deflection unit of the kind described in the opening paragraph, in which, whilst maintaining the advantages of sets of coils of the saddle type directly wound onto the support, a high sensitivity especially of the line deflection coils and a good possibility of minimizing Y coma errors are obtained.

According to the invention this object is achieved in an electromagnetic deflection unit of the kind described in the opening paragraph in that the field deflection coils each have a first part and a second part, which are electrically connected in series, the first part of each of the field deflection coils being wound first against the inner side of the support, whereupon the set of line deflection coils and then the second part of each of the field deflection coils are wound onto this support, and in that at the narrow end of the support the second part of each of the field deflection coils extend in the direction of the longitudinal axis of the support beyond the line deflection coils.

Due to the arrangement according to the invention, in a deflection unit having coils of the saddle type directly wound onto the support, the coils for line deflection are located close to the longitudinal axis (and consequently in this deflection unit, arranged to surround a cathode-ray tube, close to the neck-shaped part of this tube). Nevertheless, the second parts of the field deflection coils, being longer at the narrow end of the support, offer the possibility of minimizing Y coma errors.

This possibility is already present to a sufficient extent if less than 50% of the number of turns of the field deflection coils are situated in the second parts. Very satisfactory results were obtained with 20% to 40% of the number of turns being situated in these second parts.

It has proved to be very favourable to arrange in the second parts especially those turns of the field deflection coils of which the mainly longitudinally extending portions extend near the field coil separation plane. Near the field coil separation plane, in fact generally no longitudinal portions of turns of the line deflection coils extend. When turns of the field deflection coil having their longitudinal portions near the field coil separation plane are arranged in the second parts, no or substantially no turns of the line deflection coils are thus positioned at a larger distance from the longitudinal axis and the sensitivity of these coils is consequently not or substantially not reduced.

The hollow annular support of the electro-magnetic deflection unit according to the invention may be a body of synthetic material having at its narrow and at its wide end a flange with grooves through which extend turns of the sets of deflection coils. A yoke ring of soft magnetic material may be embedded in this body, but alternatively a yoke ring may surround this body. Another possibility consists in that a yoke ring is itself a support and carries at its narrow and wide ends flanges of synthetic material with grooves for turns of the sets of deflection coils. The flanges have tangential grooves, in which the turns of the deflection coil are flanged. At the wide end of the support, the flange may have one or more grooves, in dependence upon the area to which the line deflection coils and the first and second parts of the field deflection coils extend. These coils and these parts may be flanged together in one tangential groove or may be flanged each in an individual tangential groove. The line deflection coils and the first and second parts of the field deflection coils extend on the inner side of the support from the flange at the wide end to the flange at the narrow end. The flange at the narrow end generally has two or more tangential grooves: a tangential groove farthest remote from the wide end for the second part of each of the field deflection coils and a more adjacent groove in which first turns on the first part of the field deflection coils and then the turns of the line deflection coils are flanged. Alternatively, it is possible that there is a first tangential groove for the first parts of the field deflection coils, a second tangential groove for the line deflection coils and a third tangential groove for the second parts of the field deflection coils.

Electromagnetic deflection units are known, in which the field deflection coils each consist of more than one part. In the manufacture of these units, however, several parts have to be joined. Such a deflection unit is known, for example, from European Pat. No. EP 1 011 5659 A1, corresponding to U.S. Pat. No. 4,455,542, issued June 19, 1984. In this case, the field deflection coils each have a first and a second part but are not wound directly onto the support, are located on the outer side of the support and are mutually separated in the axial direction of the support.

BRIEF DESCRIPTION OF THE DRAWINGS

An embodiment of an electromagnetic deflection unit according to the invention is shown in the drawings, in which.

DESCRIPTION OF THE PREFERRED EMBODIMENTS

Figure 1:
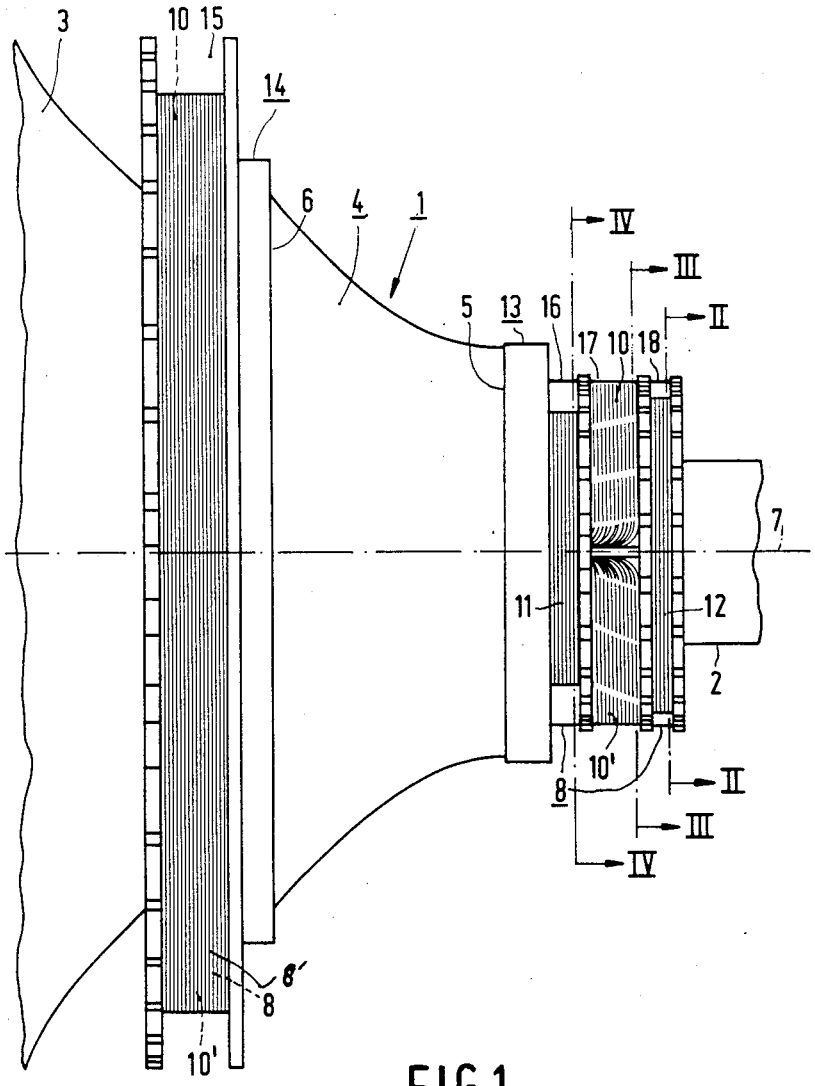
FIG. 1 is a side elevation of a deflection unit provided on a cathode-ray tube.

In FIG. 1, the electromagnetic deflection unit 1 is arranged on a cathode-ray comprising a neck-shaped portion 2 and a conical portion 3. The deflection unit 1 has a hollow annular support 4, which has a narrow and a wide end 5 and 6, respectively, and a longitudinal axis 7. A set of field deflection coils 8, 8' (FIG. 2) of the saddle type for field deflection of an electron beam is wound directly onto the support 4 on the inner side thereof. The field deflection coils 8, 8' are located on respective sides of a field coil separation plane (9, FIG. 2) through the longitudinal axis 7 of the support 4 and have a plurality of turns with mainly longitudinally extending portions 22, 22' (FIGS. 3, 4) portions which extend mainly longitudinally of the support). A set of line deflection coils 10, 10' of the saddle type for line deflection of an electron beam is likewise wound directly onto the support 4 on the inner side thereof.

The field deflection coils 8, 8' each have a first part 11 and 11', respectively, (FIG. 4) and a second part 12 and 12', respectively (FIG. 2), which (11, 12 and 11', 12', respectively) are connected electrically in series. The first part 11, 11' is wound first against the inner side of the support 4, whereupon the set of line deflection coils 10, 10' and then the second part 12, 12' of the field deflection coils 8 and 8', respectively, are wound on the inner side of this support 4. The second part 12, 12' of the field deflection coils 8, 8' extends at the narrow end 5 of the support 4 in the direction of the longitudinal axis thereof beyond the line deflection coils 10, 10'.

In FIG. 1, the support 4 of the deflection unit 1 has at its narrow end 5 a flange 13 and at its wide end a flange 14. The flange 14 has in the embodiment shown one tangential groove 15, in which both the turns of the first parts 11, 11' of the field deflection coils 8 and 8', respectively, and the line deflection coils 10, 10' as well as the second parts 12, 12' of the field deflection coils 8 and 8', respectively, are flanged. Consequently, at the wide end 6 of the support 4, the line deflection coils 10, 10', the first parts 11, 11' and the second parts 12, 12' of the field deflection coils 8 and 8', respectively, terminate at the same area. At the narrow end 5 of the support 4, the flange 13 has three tangential grooves 16, 17, 18. In the embodiment shown, the first part 11 and 11', respectively, of the field deflection coils 8, 8' is flanged in the groove 16. The line deflection coils 10, 10' extend further in the direction of the longitudinal axis 7 and their turns are flanged in the groove 17 so that they overlap completely the first parts 11, 11'. The turns of the last wound second parts 12, 12' are flanged in the groove 18. The second parts 12, 12' overlap the first parts 11, 11' and the line deflection coils 10, 10' therefore completely and are the longest parts.

Figure 2:
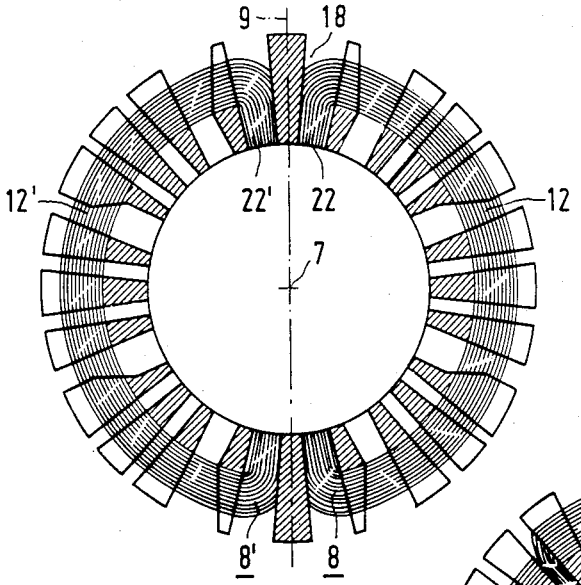
FIGS. 2, 3 and 4 are sectional views of FIG. 1 taken on II—II, III—III and IV—IV, respectively.

FIG. 2 shows the field coil separation plane 9 through the longitudinal axis 7 of the support 4. The turns of the second parts 12, 12' of the field deflection coils 8, 8' have their mainly longitudinally extending portions 22, 22' near the field coil separation plane 9.

Figure 3:
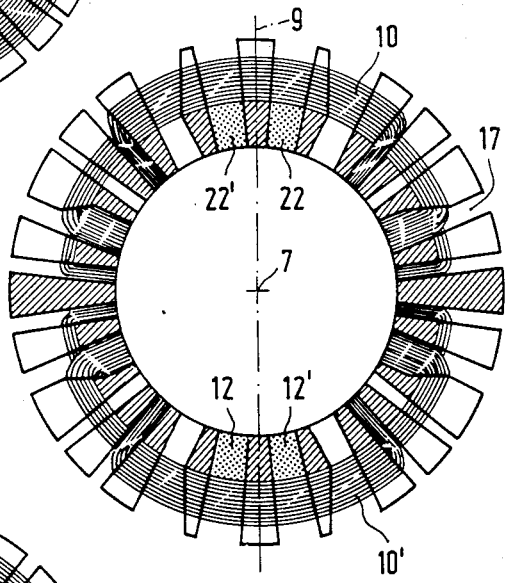

FIG. 3 shows that the line deflection coils 10, 10' have at least at the narrow end (5) shown of the support (4) no turns with mainly longitudinally extending portions near the field coil separation plane 9 so that the turns of the second parts 12, 12' are not located over turns of the line deflection coils 10, 10'. In the immediate proximity of the wide end 6, turns of the line deflection coils 10, 10' have near the field coil separation plane 9 mainly longitudinally extending portions, but these parts are very small in number.

Figure 4:
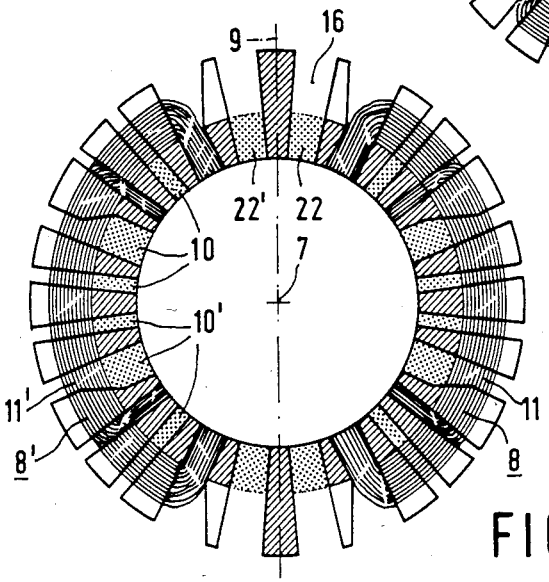

FIG. 4 shows the bundles of turns of the first parts 11, 11' of the field deflection coils 8, 8' flanged in the groove 16 and bundles of turns of the line deflection coils 10, 10' and of the second parts 12, 12' passing this groove.

In the embodiment shown, about 30% of the turns of the field deflection coils 8, 8' are located in the second parts 12, 12' thereof.

What is claimed is:

1. An improved electromagnetic deflection unit for a cathode-ray tube, comprising:

a hollow annular support having a longitudinal axis and a narrow and a wide end, a set of field deflection coils of the saddle type for field deflection of an electron beam, these deflection coils being located on respective sides of a field coil separation plane through the longitudinal axis of the support and having a plurality of turns comprising portions which extend mainly longitudinally of the support, and a set of line deflection coils of the saddle type for line deflection of said electron beam, the set of line deflection coils being wound directly onto said support on the inner side thereof;

such improvement being characterized in that the field deflection coils each comprise a first part and a second part which are connected electrically in series, the first part of each of the field deflection coils being wound against the inner side of said support and the second part of each of the field deflection coils being wound against the set of line deflection coils, and in that at the narrow end of the support the portions of the turns of the second part of each of the field deflection coils which extend in the direction of the longitudinal axis of the support so extend beyond the line deflection coils.

2. An electromagnetic deflection unit as claimed in claim 1, characterized in that the longitudinally extending portions of the turns of the second part of each of the field deflection coils so extend near the field coil separation plane.

* * * * *